US006225857B1

(12) United States Patent
Brokaw

(10) Patent No.: US 6,225,857 B1
(45) Date of Patent: May 1, 2001

(54) NON-INVERTING DRIVER CIRCUIT FOR LOW-DROPOUT VOLTAGE REGULATOR

(75) Inventor: A. Paul Brokaw, Burlington, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/499,706

(22) Filed: Feb. 8, 2000

(51) Int. Cl.[7] ..... G05F 1/10
(52) U.S. Cl. ..... 327/540
(58) Field of Search ..... 323/311, 312, 323/313; 327/530, 534, 535, 537, 538, 540, 541, 542, 543, 545, 546

(56) References Cited

U.S. PATENT DOCUMENTS 5,373,226 * 12/1994 Kimura ..... 323/312
5,631,598 5/1997 Miranda et al. ..... 327/540
5,886,570 * 3/1999 Brokaw ..... 327/540
5,929,617 * 7/1999 Brokaw ..... 323/280

* cited by examiner

*Primary Examiner*—Jeffrey Zweizig
(74) *Attorney, Agent, or Firm*—Koppel & Jacobs

(57) ABSTRACT

A non-inverting driver circuit for an LDO pass device employs a level-shifting inverter stage followed by a normalizing inverter stage. The level-shifting stage converts the output common-referenced output of the error amplifier to a current, which is provided to the normalizing inverter. The normalizing stage is referred to the LDO input voltage, enabling its output signal to remain largely invariant with respect to changes in input voltage. The driver is preferably configured to have a low output impedance, so that when driving the high gate capacitance of a MOS pass device, the resulting pole is moved to a higher frequency than would be possible with a non-inverting driver having a high output impedance. With the driver being non-inverting and the low frequency pole moved higher, frequency compensating the regulator is simplified.

14 Claims, 4 Drawing Sheets

NON-INVERTING DRIVER CIRCUIT FOR LOW-DROPOUT VOLTAGE REGULATOR

BACKGROUND OF THE INVENTION

1. Field of the Invention

This invention relates to the field of linear voltage regulators, and particularly to pass transistor driver circuits for low-dropout voltage regulators.

2. Description of the Related Art

Low-dropout (LDO) voltage regulators, i.e., regulators which must operate with a small difference between their input and regulated output voltages, can be difficult to frequency compensate. U.S. Pat. No. 5,631,598 to Miranda et. al (assigned to the present assignee), described an implementation of an LDO voltage regulator which facilitated the use of a desirable frequency compensation scheme. A simplified schematic of the LDO described therein is shown in FIG. 1. A supply voltage $V_{in}$ is connected to the emitter 10 of a pass transistor 12, typically a pnp bipolar transistor, and an output voltage $V_{out}$ is taken at the transistor's collector 14. The output voltage is regulated by controlling pass transistor 12 via its base terminal 16. Regulation is accomplished with a feedback loop: a signal 17 representative of the output voltage is fed back to the non-inverting input 18 of an error amplifier 20, usually via a voltage divider 22. A reference voltage Vref is connected to the inverting input 24 of the amplifier. The amplifier's output 25 is connected to the input 26 of an inverting amplifier 28, whose output is connected to the base of a drive transistor 30 which provides the drive current for pass transistor 12. Inverting amplifier 28 and drive transistor 30 provide two inversions, and in combination form a non-inverting driver circuit 32. With a non-inverting driver circuit employed in this way, the regulator can be frequency compensated by connecting a compensation network 34 between $V_{out}$ and the output 25 of error amplifier 20.

However, using a non-inverting driver of this sort can present a problem, particularly when a MOS pass device is used. The large MOSFET needed to handle large output currents will have a large gate capacitance. At the same time, the pass device is driven from a high impedance node of the driver circuit—in this case, the collector of drive transistor 30. The high impedance driver combined with the large gate capacitance result in a low frequency pole in the loop transfer function, which can prove troublesome when trying to frequency stabilize the LDO in the face of highly variable load resistance and reactance.

SUMMARY OF THE INVENTION

A non-inverting driver circuit for an LDO is presented which overcomes the problem described above. The novel non-inverting driver enables the use of the frequency compensation scheme referred to above, and also presents a low output impedance, such that the pole resulting from the driver output impedance/gate capacitance combination is moved to a higher frequency than would otherwise be possible, thereby simplifying the frequency compensation task.

The new non-inverting driver circuit employs a level-shifting inverter stage followed by a normalizing inverter stage. The level-shifting inverter converts the output common-referenced error amplifier output (i.e., the amplifier output is referenced to the same common point as the load to which the LDO is connected) to a current. The current is delivered to the normalizing inverter, which produces a drive signal to the LDO's pass device that is referred to the LDO input voltage, enabling the drive signal to remain substantially invariant with respect to the input voltage. The normalizing inverter stage is also preferably configured to have a low output impedance, so that when driving the high gate capacitance of a MOS pass device, the resulting pole is moved to a higher frequency than would be possible with a driver circuit having a high output impedance. With the pole moved higher, frequency compensating the regulator is simplified. Though most beneficial when used with a MOS pass device, the non-inverting driver can also be advantageously employed with a bipolar pass transistor.

Further features and advantages of the invention will be apparent to those skilled in the art from the following detailed description, taken together with the accompanying drawings.

DETAILED DESCRIPTION OF THE INVENTION

Figure 2:
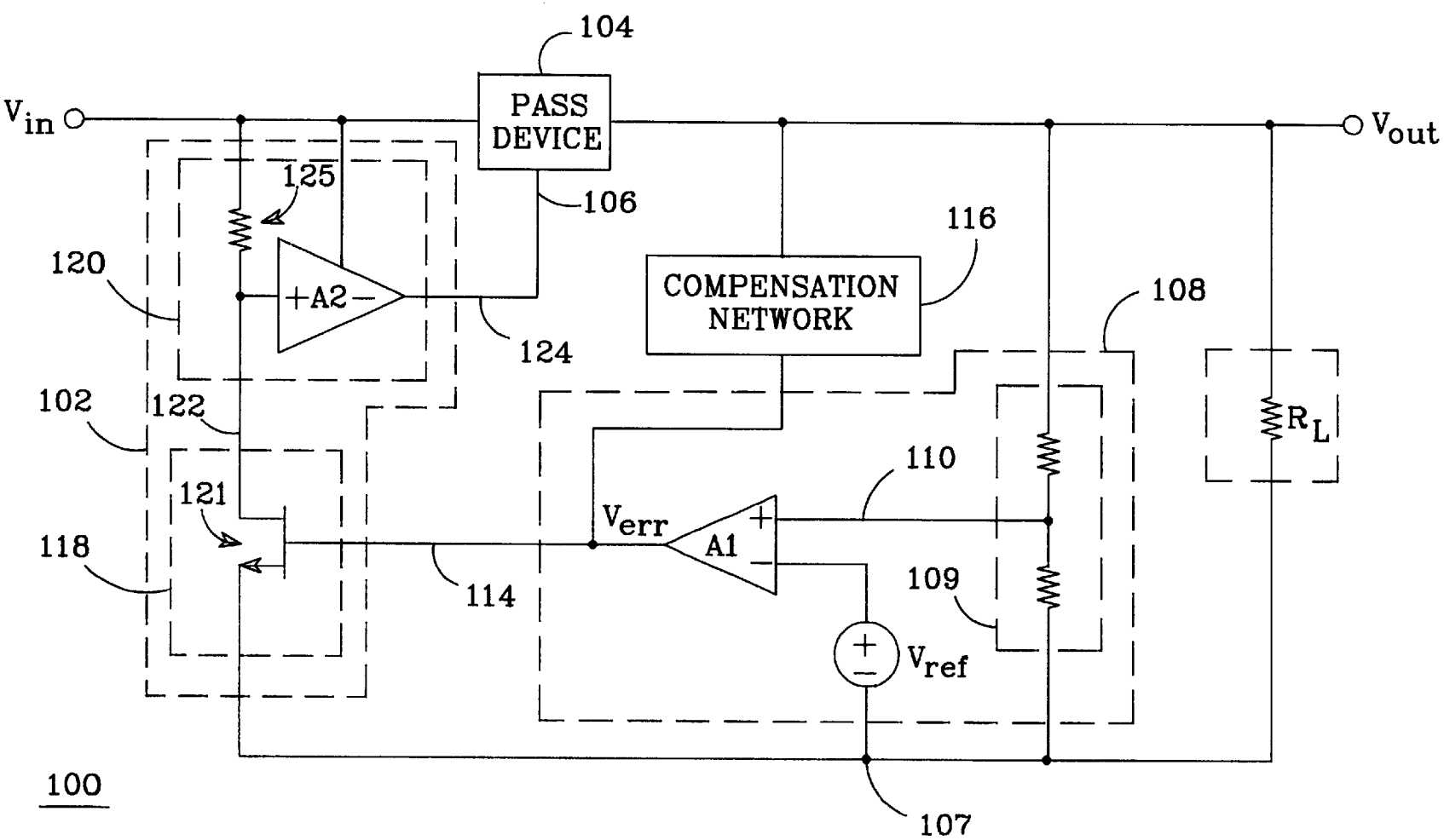
FIG. 2 is a block diagram of an LDO employing a non-inverting driver circuit per the present invention.

A block diagram of an LDO 100 employing a non-inverting driver circuit 102 per the present invention is shown in FIG. 2. A pass device 104 is connected to an input voltage $V_{in}$ and produces an output voltage $V_{out}$ in response to a drive signal received at a control input 106. The LDO drives a load $R_L$ which is referenced to an output common point 107. The output voltage is regulated by means of a feedback circuit 108. Feedback circuit 108 includes a circuit 109, typically a voltage divider, which is connected to $V_{out}$ and produces a signal 110 representative of the output voltage. Signal 110 is provided to the non-inverting input of an error amplifier A1, and a reference voltage $V_{ref}$ is connected to A1's inverting input. Al produces an output common-referenced (i.e., referenced to output common point 107) error voltage $V_{err}$ as an output.

Error voltage $V_{err}$ is delivered to the input 114 of non-inverting driver circuit 102. Because driver circuit 102 is non-inverting, the frequency compensation scheme described in the above-referenced U.S. Pat. No. 5,631,598 can be employed: as illustrated in FIG. 2, a compensation network 116 is connected between $V_{out}$ and non-inverting driver circuit input 114.

Non-inverting driver circuit 102 includes an output common-referenced level-shifting inverter stage 118, and a normalizing inverter stage 120 which is referred to the LDO's input voltage $V_{in}$. Level-shifting inverter stage 118 receives error voltage $V_{err}$ at input 114, and produces an output 122 which varies inversely with $V_{err}$; i.e., the voltage of output 122 falls as $V_{err}$ increases. Stage 118 is implemented with, for example, a transistor 121 connected to convert output common-referenced error voltage $V_{err}$ to a current at output 122.

Normalizing inverter stage 120 receives output 122 and produces a drive signal 124 which varies inversely with output 122; drive signal 124 is connected to pass device control input 106. The normalizing inverter stage is referred to LDO input voltage $V_{in}$, enabling drive signal 124 to remain substantially invariant with respect to $V_{in}$, and to directly drive pass device 104. Inverter stage 120 is implemented with, for example, a resistor 125 which develops a voltage in response to the current at output 122, and an inverter A2 referred to $V_{in}$ which inverts the developed voltage to produce drive signal 124. The two inversions provided by stages 118 and 120 ensure that drive signal 124 is in phase with the signal applied to non-inverting driver circuit input 114, enabling the use of the aforementioned frequency compensation scheme.

Normalizing inverter stage 120 is preferably designed to have a low output impedance. This is particularly advantageous when pass device 104 is a MOSFET. A large MOSFET as might be required to handle large currents has a corresponding large gate capacitance. As noted above, pass devices in prior art LDOs have typically been driven from high impedance nodes of their respective driver circuits. The high impedance driver combined with the large gate capacitance results in a low frequency pole in the loop transfer function, which can be very troublesome when trying to frequency stabilize the LDO in the face of highly variable load resistance and reactance. However, when the output impedance of normalizing inverter stage 120 is low, the low frequency pole in the loop transfer function is moved to a higher frequency, making it easier to deal with in the loop transfer.

Figure 1:
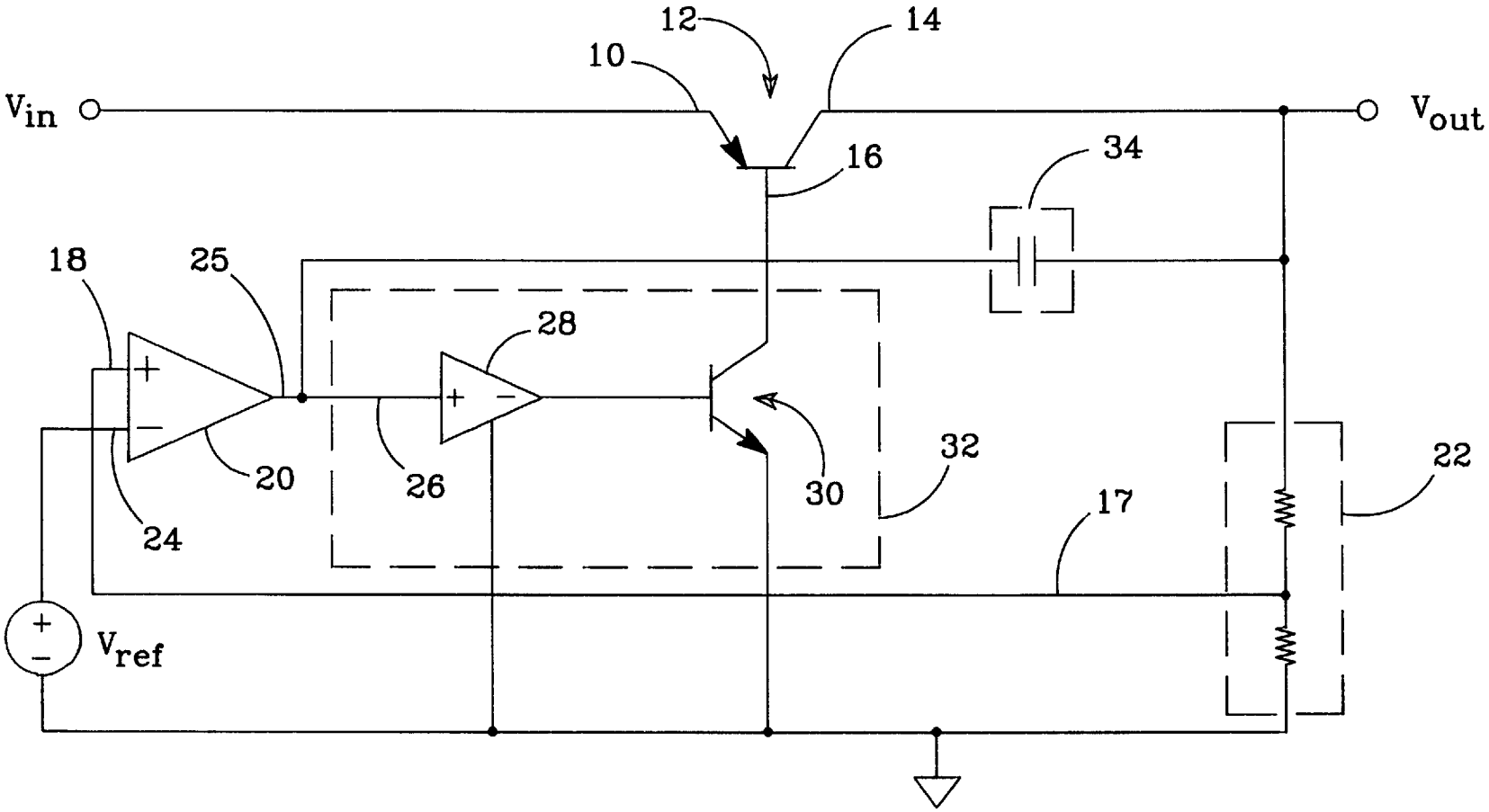
FIG.1 (Prior Art)
FIG. 1 is a schematic diagram of a prior art low-dropout (LDO) voltage regulator employing a non-inverting driver circuit.

Configuring level-shifting inverter stage 118 and normalizing inverter stage 120 as described herein, and placing normalizing stage 120 after level-shifting stage 118 instead of before it as in the prior art regulator shown in FIG. 1, enable a number of desirable characteristics to be realized. This arrangement enables the output of non-inverting driver circuit 100 to have the low output impedance needed to drive a MOS pass device, and to be referred to $V_{in}$ so that drive signal 124 is largely invariant with respect to changes in input voltage $V_{in}$. By forming a non-inverting driver circuit, it also enables the use of the frequency compensation scheme described in U.S. Pat. No. 5,631,598. Thus, the present invention provides a wide array of advantages, particularly when used as part of an all-MOS LDO.

Figure 3:
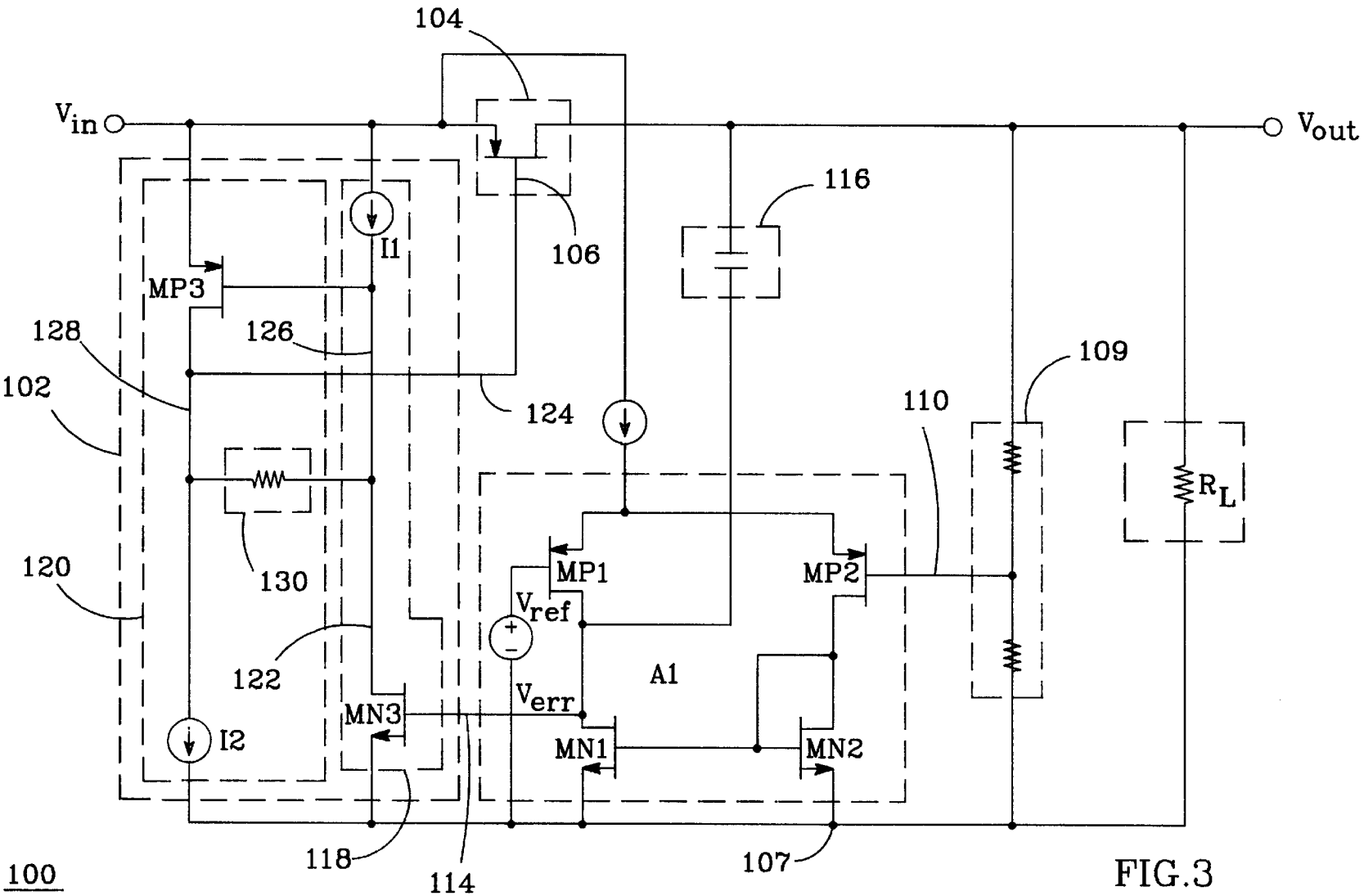
FIG. 3 is a schematic diagram of a preferred embodiment of the present invention.

A preferred embodiment of non-inverting driver circuit 102, as employed in LDO 100, is shown in the schematic diagram of FIG. 3. Here, pass device 104 is a p-channel MOSFET, having its source connected to $V_{in}$ and producing output voltage $V_{out}$ at its drain in response to the drive signal 124 applied to its gate 106. Error amplifier Al is preferably implemented as a differential amplifier, with $V_{ref}$ and the signal representative of $V_{out}$ (110) applied to the respective gates of a differential pair MP1 and MP2, which are biased with a pair of transistors MN1 and MN2 connected in a current mirror configuration and connected to MP1 and MP2, respectively. Error voltage $V_{err}$ is taken at the junction of MN1 and MP1. As configured in FIG. 3, $V_{err}$ increases with $V_{out}$ when $V_{out}>V_{ref}$, and decreases with $V_{out}$ when $V_{out}<V_{ref}$.

Level-shifting inverter stage 118 of non-inverting driver circuit 102 comprises a current source I1 series-connected to an n-channel FET MN3, with MN3's source connected to output common 107, its gate connected to $V_{err}$ and serving as the input 114 of non-inverting driver circuit 102, and its drain connected to the output of I1 at a node 126. Normalizing inverter stage 120 comprises a p-channel FET MP3 series-connected to a current source I2, with MP3's source connected to $V_{in}$, its gate connected to node 126, and its drain connected to I2 at a node 128. A resistance 130 is connected between nodes 126 and 128.

MN3 converts the output common-referenced error voltage $V_{err}$ to a current at node 126: MN3 is nominally biased by I1, but its actual output current is modulated by $V_{err}$, Any difference between the actual MN1 drain current and bias current I1 is delivered to resistance 130 (except for the displacement current that charges MP3's gate capacitance), thereby disturbing the voltage at node 126, which is the gate voltage for MP3. MP3 is nominally biased by I2, but its actual output current is modulated by the voltage at node 126, with any difference between the actual MP3 drain current and bias current I2 delivered to the other side of resistance 130 (except for the displacement current that charges the gate capacitance of pass device 104). The voltage at node 128 is drive signal 124, which is connected to the gate of pass device 104.

MN3's drain current changes with $V_{err}$, causing the current into resistance 130 and the voltage at node 126 to change as well (after MP3's gate capacitance is charged). This affects MP3's drain current, moving the voltage at node 128 in the direction opposite to that of the voltage at node 126 (after the pass device's gate capacitance is charged). Thus, the voltage across resistance 130 changes to accommodate changes in MN3's drain current, with the circuit reaching equilibrium when the two difference currents are equal.

With the two currents diverted to resistance 130 equal, non-inverting driver circuit 102 provides an amplified and in-phase version of $V_{err}$ to pass device 104. Resistance 130 turns MP3 and I2 into a shunt feedback amplifier, the output impedance of which is on the order of the reciprocal of MP3's transconductance. This output impedance is the output impedance of non-inverting driver circuit 102, and its low value moves the loop transfer function's low frequency pole to a higher frequency and thereby allows pass device 104 to be driven to wide bandwidth. The non-inverting nature of the driver circuit also permits the utilization of the frequency compensation scheme referred to above, as illustrated in FIG. 3 with the connection of compensation network 116, here realized with a single capacitor, between $V_{out}$ and the input 114 of non-inverting driver circuit 102.

Note that the invention is not limited to the non-inverting driver configuration shown in FIG. 3. It is only essential that an output common-referenced level-shifting inverter stage be followed by a normalizing inverter stage referred to the regulator's input voltage, which can be achieved with a number of circuit topologies. Similarly, the arrangement of the other components making up the LDO is not limited to the configuration shown in FIG. 3; many other circuit implementations could be successfully used to provide an error voltage of the proper polarity to the novel non-inverting driver circuit.

Figure 4:
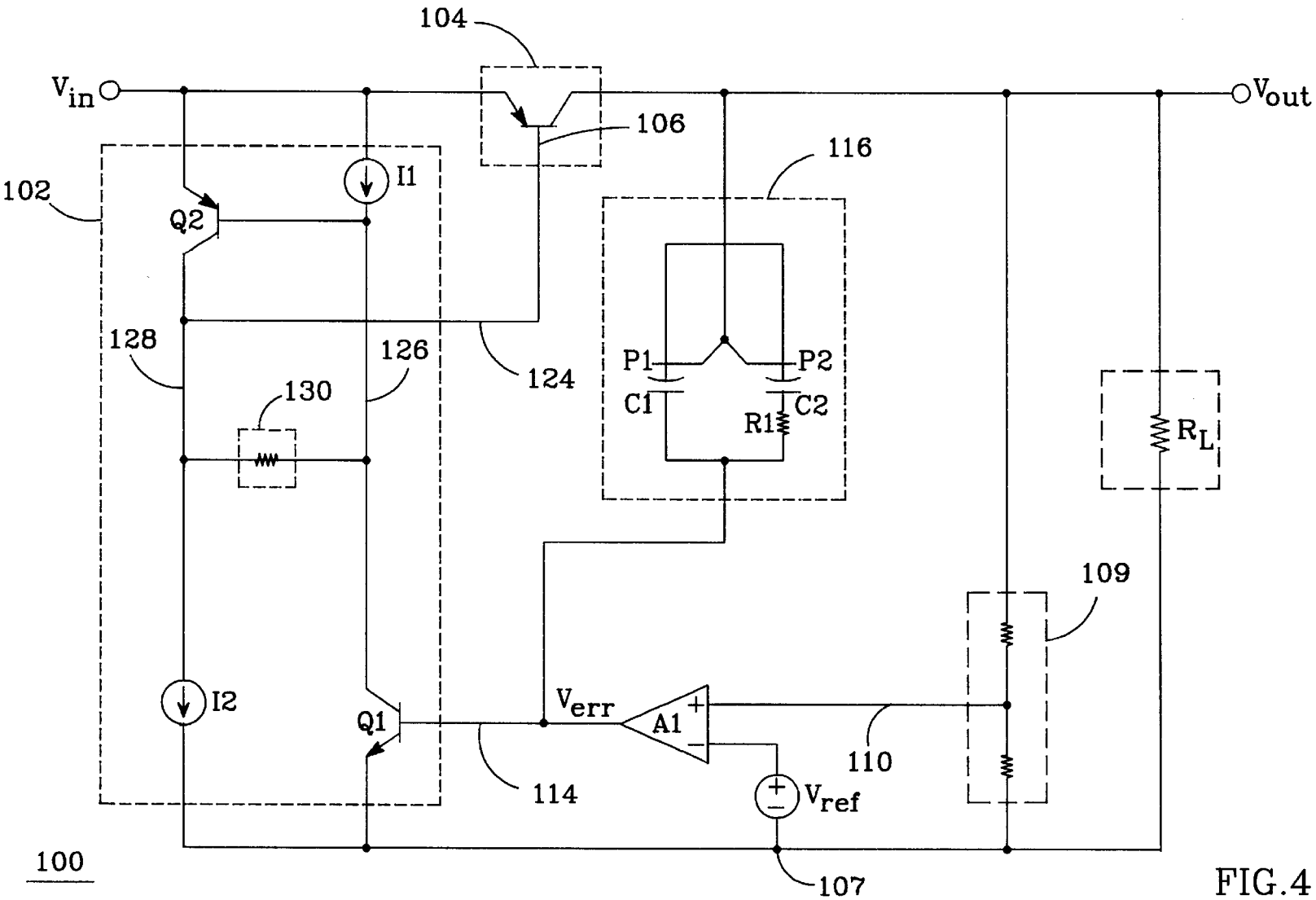
FIG. 4 is a schematic diagram of an alternative embodiment of the present invention

The non-inverting driver circuit 102 and pass device 104 shown in FIG. 3 are implemented exclusively with FETs, and it is this configuration that best realizes the invention's advantages with respect to frequency compensation. However, the invention is not limited to a FET implementation. A schematic of a bipolar implementation of LDO 100 and non-inverting driver circuit 102 is shown in FIG. 4. Pass device 104 is implemented with a pnp transistor, which receives drive signal 124 at its base 106. Circuit 109 and error amplifier Al are as before, though Al is likely to be implemented with bipolar transistors instead of FETs. The level-shifting inverter stage of non-inverting driver circuit 102 comprises an npn transistor Q1 with its collector connected to current source I1 at node 126, its emitter connected to output common 107, and its base serving as non-inverting driver circuit input 114. The normalizing inverter stage is realized with a pnp transistor Q2 with its emitter connected to $V_{in}$, its collector connected to current source I2 at node 128, and its base connected to node 126. Resistance 130 is connected between 128 and 126. The operation of the non-inverting circuit is as before, with Q1 converting $V_{err}$ to a current at node 126 which is fed to Q2, which provides $V_{in}$-referred drive signal 124 to pass device 104.

FIG. 4 includes a more complex compensation network 116 connected between $V_{out}$ and input 114 of non-inverting driver circuit 102. The network includes a resistor R1 and a pair of capacitors C1 and C2 having respective parasitic capacitors P1 and P2 below them. The diffusion creating the parasitics can be isolated and connected to a circuit node, such as to $V_{out}$ as shown in FIG. 4. The compensation networks shown in FIGS. 3 and 4 are merely exemplary; a virtually unlimited number of implementations are possible.

As noted above, the present invention can be implemented with FETs or with bipolar transistors. It should also be noted that functional circuits similar to those shown in FIGS. 3 and 4 could be implemented with transistors having polarities opposite to those shown.

While particular embodiments of the invention have been shown and described, numerous variations and alternate embodiments will occur to those skilled in the art. Accordingly, it is intended that the invention be limited only in terms of the appended claims.

I claim:

1. A non-inverting driver circuit for driving the pass device of a low dropout (LDO) voltage regulator, comprising:

a pass device having a control input, said pass device connected to receive an input voltage and to produce an output voltage in accordance with a drive signal applied to said control input, said output voltage connected to a load referenced to an output common point, a level-shifting inverter stage arranged to receive an error voltage which is referenced to said output common point and which varies with the difference between said output voltage and a reference voltage and to produce a first output signal which varies inversely with said error voltage, and a normalizing inverter stage arranged to receive said first output signal at an input and to produce a second output signal which varies inversely with said first output signal, said second output signal being said drive signal applied to said control input, said normalizing inverter referred to said input voltage such that said drive signal remains substantially invariant with respect to said input voltage.

2. The driver circuit of claim 1, wherein said pass device is a MOSFET having an associated gate capacitance, said MOSFET's gate being said control input, said normalizing inverter stage arranged to have a low output impedance such that the pole produced by said output impedance in combination with said gate capacitance is at a higher frequency than would otherwise be produced.

3. The driver circuit of claim 1, wherein said level shifting inverter stage comprises:

a current source, and a transistor having a control input and a current circuit, said current circuit connected between said normalizing inverter stage's input and said output common point, said current source connected to provide a bias current to said transistor, said transistor connected to receive said error voltage at said control input and to conduct an output current which is modulated by said error voltage, said output current being said first output signal.

4. The driver circuit of claim 1, wherein said normalizing inverter stage comprises:

a current source, a second transistor having a control input and a current circuit, said current circuit connected between said pass transistor's control input and said input voltage, said current source connected to provide a bias current to said second transistor, said second transistor connected to receive said first output signal at said control input and to conduct an output current which is modulated by said first output signal, said output current being said drive signal, and a resistance connected between said drive signal and said first output signal, said current source, said second transistor, and said resistance forming a shunt feedback amplifier having an output impedance which is approximately given by $1/g_m$, where $g_m$ is the transconductance of said second transistor.

5. A non-inverting driver circuit for driving the pass device of a low dropout (LDO) voltage regulator, comprising:

a pass device having a control input, said pass device connected to receive an input voltage and to produce an output voltage in accordance with a drive signal applied to said control input, said output voltage connected to a load referenced to an output common point, a current source which provides a first bias current, a first transistor biased with said first bias current, said first transistor connected to receive an error voltage which is referenced to said output common point and which varies with the difference between said output voltage and a reference voltage and to conduct a first output current which is modulated by said error voltage, a second current source which provides a second bias current, a second transistor biased with said second bias current, said second transistor connected to receive said first output current and to conduct a second output current which is modulated by said first output current, said second output current being said drive signal, and a resistance connected between said first output current and said drive signal, said resistance, said second transistor, and said second current source forming a shunt feedback amplifier having a low output impedance which is approximately given by $1/g_m$, where $g_m$ is the transconductance of said second transistor.

6. The driver circuit of claim 5, wherein said pass device is a MOSFET having an associated gate capacitance, said driver circuit arranged such that said shunt feedback amplifier's low output impedance in combination with said gate capacitance produces a pole at a higher frequency than would be otherwise be produced.

7. The driver circuit of claim 6, wherein said first transistor and said second transistor are MOSFETs.

8. The driver circuit of claim 5, wherein said pass device, said first transistor, and said second transistor are bipolar transistors.

9. A non-inverting driver circuit for driving the pass device of a low dropout (LDO) voltage regulator, comprising:

a MOS pass transistor, said MOS pass transistor connected to receive an input voltage and to produce an output voltage in accordance with a drive signal applied to its gate, said output voltage connected to a load referenced to an output common point, a first current source which provides a first bias current, a first field-effect transistor (FET) having its gate connected to an error voltage which is referenced to said output common point and which varies with the difference between said output voltage and a reference voltage and its drain-source circuit connected between said first current source and said output common point, said first FET conducting a first output current which is modulated by said error voltage, a second current source which provides a second bias current, a second FET having its gate connected to said first output current and its drain-source circuit connected between said input voltage and said pass transistor's gate, said second FET conducting a second output current which is modulated by said first output current, said second output current being said drive signal, and a resistance connected between said first output current and said drive signal, said resistance, said second transistor, and said second current source forming a shunt feedback amplifier having a output impedance which is approximately given by $1/g_m$, where $g_m$. is the transconductance of said second transistor.

10. A low-dropout (LDO) voltage regulator, comprising:

a pass transistor having a current circuit and a control input, said current circuit connected between an input voltage and an output terminal and producing an output voltage at said output terminal in response to a drive signal applied to said control input, said output voltage connected to a load referenced to an output common point, an error amplifier connected to receive a signal representative of said output voltage at a first input and a reference voltage at a second input and outputting an error voltage which is referenced to said output common point and which varies with the difference between said output voltage and said reference voltage, and a non-inverting driver circuit for driving said pass transistor, said non-inverting driver circuit comprising:

a level-shifting inverter stage arranged to receive said error voltage and to produce a first output signal which varies inversely with said error voltage, and a normalizing inverter stage arranged to receive said first output signal at an input and to produce a second output signal which varies inversely with said first output signal, said second output signal being said drive signal applied to said control input, said normalizing inverter referred to said input voltage such that said drive signal remains substantially invariant with respect to said input voltage.

11. The LDO of claim 10, further comprising a frequency compensation network connected between said output terminal and the output of said error amplifier.

12. A low-dropout (LDO) voltage regulator, comprising:

a MOS pass transistor, said MOS pass transistor connected to receive an input voltage and to produce an output voltage in accordance with a drive signal applied to its gate, said output voltage connected to a load referenced to an output common point, an error amplifier connected to receive a signal representative of said output voltage at a first input and a reference voltage at a second input and outputting an error voltage which is referenced to said output common point and which varies with the difference between said output voltage and said reference voltage, and a non-inverting driver circuit for driving said MOS pass transistor, said non-inverting driver circuit comprising:

a current source which provides a first bias current, a first field-effect transistor (FET) having its gate connected to said error voltage and its drain-source circuit connected between said current source and said output common point, said first FET conducting a first output current which is modulated by said error voltage, a second current source which provides a second bias current, a second FET having its gate connected to said first output current and its drain-source circuit connected between said input voltage and said pass transistor's gate, said second FET conducting a second output current which is modulated by said first output current, said second output current being said drive signal, and a resistance connected between said first output current and said drive signal, said resistance, said second transistor, and said second current source forming a shunt feedback amplifier having a output impedance which is approximately given by $1/g_m$, where $g_m$ is the transconductance of said second transistor.

13. The LDO of claim 12, further comprising a frequency compensation network connected between said output terminal and the output of said error amplifier.

14. The LDO of claim 12, wherein said MOS pass transistor has an associated gate capacitance, said non-inverting driver circuit arranged such that said shunt feedback amplifier's low output impedance in combination with said gate capacitance produces a pole at a higher frequency than would be otherwise be produced.

* * * * *